US005942056A

United States Patent [19]

Singh

[11] Patent Number: 5,942,056

[45] Date of Patent: Aug. 24, 1999

[54] PLUMBING FIXTURES AND FITTINGS EMPLOYING COPPER-BISMUTH CASTING ALLOYS

[75] Inventor: Akhileshwar R. Singh, Pepper Pike, Ohio

[73] Assignee: Federalloy, Inc., Bedford, Ohio

[21] Appl. No.: 08/471,908

[22] Filed: Jun. 7, 1995

Related U.S. Application Data

[60] Division of application No. 08/195,277, Feb. 14, 1994, Pat. No. 5,487,867, which is a continuation-in-part of application No. 08/063,435, May 18, 1993, Pat. No. 5,330,712, which is a continuation-in-part of application No. 08/051,161, Apr. 22, 1993, abandoned.

[51] Int. Cl.[6] ..... C22C 9/04

[52] U.S. Cl. ..... 148/434; 420/473; 420/481; 420/499

[58] Field of Search ..... 420/473, 481, 420/499; 148/434

[56] References Cited

U.S. PATENT DOCUMENTS

| | | | |
|---|---|---|---|
| 4,148,633 | 4/1979 | Parikh | 148/681 |
| 4,347,413 | 8/1982 | Watanabe et al. | 200/144 B |
| 4,879,094 | 11/1989 | Rushton | 420/476 |

FOREIGN PATENT DOCUMENTS

| | | |
|---|---|---|
| 51-62129 | 5/1976 | Japan . |
| 57-73149 | 5/1982 | Japan . |
| 57-76142 | 5/1982 | Japan . |
| 63-266053 | 11/1988 | Japan . |
| 1-123041 | 5/1989 | Japan . |
| 2027449 | 2/1980 | United Kingdom . |

OTHER PUBLICATIONS

Krajewski, W et al, "Thermogravimetric Oxidation Tests in Copper Alloys with Rare Earths," Thermochim. ACTA (1977), 20(v), 93–106 (only abstract cited).

Korolikov et al, "Influence of Rare–Earth Metals on the Structure and High–Temperature Strength of Copper and Copper–ZN Alloys." Izu. Akad. Nauk SSR, Metal. (1970), (3), 165–70 (only abstract cited).

*Primary Examiner*—Sikyin Ip
*Attorney, Agent, or Firm*—Thompson Hine & Flory LLP

[57] ABSTRACT

A plumbing fixture or fitting fabricated from a bismuth and mischmetal containing copper alloy.

15 Claims, 3 Drawing Sheets

PLUMBING FIXTURES AND FITTINGS EMPLOYING COPPER-BISMUTH CASTING ALLOYS

CROSS REFERENCE TO RELATED APPLICATIONS

This is a divisional of application Ser. No. 08/195,277 filed Feb. 14, 1994, now U.S. Pat. No. 5,487,867, which is a continuation-in-part of application Ser. No. 08/063,435 filed May 18, 1993, now U.S. Pat. No. 5,330,012, which is a continuation-in-part of application Ser. No. 08/051,161 filed Apr. 22, 1993, now abandoned.

BACKGROUND OF THE INVENTION

The present invention relates generally to copper-bismuth alloys and, more particularly, to virtually lead-free copper base casting alloys which can be substituted for conventional leaded brasses and bronzes in plumbing fixtures and other applications.

Lead, as part of traditional copper base alloys, provides two major benefits, namely, improved pressure tightness and easy machinability. Because the solubility of lead in the copper matrix upon freezing at room temperature is 50 parts per million (0.005%), it has a tendency to segregate into areas which freeze last. As a result, it will fill in any voids which may exist in the casting thereby improving pressure tightness.

Also, in copper base alloys, the distribution of lead is nonuniform in nature. This segregation of lead aids the machinability index because the tool will touch the lead-rich surfaces in the casting thereby making it easier to form small chips with ease. The presence of lead in copper base castings also makes them much easier to polish which is highly desirable as many plumbing fixtures are plated with chrome.

Nevertheless, despite the favorable casting characteristics described above, the presence of lead in castings to which people may be exposed and which are also presently utilized in a variety of manufacturing processes has created far more serious problems in the areas of health as it relates to ambient air, potable water, and the soil system. These problems are currently and forthrightly being addressed by the Occupational, Safety and Health Administration (OSHA), the Environmental Protection Agency (EPA), and both Houses of Congress.

As a consequence, OSHA is requiring all foundries that employ more than 20 people to reduce their plant ambient air levels to 50 $\mu$g of lead per cubic meter of air from the present standard of 200 $\mu$g by July 1996. This will cause millions of dollars to be spent on unproductive equipment at the affected businesses in the coming years. Currently, the EPA is moving toward reducing the lead leaching standard in drinking water from 50 $\mu$g/L, its present level, all the way down to possibly as low as 5 $\mu$g/L. Both Houses of Congress are considering a variety of measures dealing with this issue.

While the affected industries have made substantial efforts to develop a lead-free alloy, currently no such alloy is being used which is technologically feasible or economically viable in the ways discussed below. To be commercially viable, this alloy must possess acceptable castability, machinability, solderability, plateability, and resistance to corrosion characteristics. It would also be highly beneficial to all foundries if the desirable lead-free alloy could also be cast in a similar fashion to the present leaded alloys thereby eliminating the need for worker training or the purchase of new equipment. Finally, it would be highly desirable if the scrap generated from the production and use of these lead-free castings would not contaminate the scrap of the presently used leaded copper base alloys, if mixed. This would have tremendous appeal to the recycling industry—a highly beneficial and growing industry in the U.S.

One approach that has been taken to provide lead-free copper alloys is to substitute bismuth for the lead in the alloy composition. Bismuth, which is adjacent to lead in the Periodic Table, is non-toxic. It is virtually insoluble in the solid state and precipitates as pure globules during freezing in a copper base alloy. When alloyed with copper, bismuth produces a course grain size that promotes shrinkage porosity. For many years it has been recognized that bismuth is brittle as cast in copper base alloys. Nevertheless, some success with lead-free or substantially lead-free bismuth-containing copper alloys has been reported in the patent literature.

U.S. Pat. No. 4,879,094 to Rushton discloses a cast copper alloy which contains 1.5 to 7% bismuth, 5 to 15% zinc, 1 to 12% tin and the balance essentially copper.

Japanese Published Applications 57-73149 and 57-73150 to Hitachi disclose copper alloys containing bismuth which are characterized by additions of graphite and titanium or manganese. Chromium, silicon, or mischmetal may be added to the alloy.

U.S. Pat. No. 5,167,726 to AT&T Bell Laboratories discloses a wrought copper alloy containing bismuth and phosphorous, tin or indium.

U.S. Pat. No. 5,137,685 discloses a copper alloy in which the lead content is reduced by the addition of bismuth. The alloy nominally contains 30 to 58% zinc. To improve its machinability, a sulfide, telluride, or selenide may be added to the alloy or, to enhance the formation of sulfides, tellurides and selenides, an element which combines with them such as zirconium, manganese, magnesium, iron, nickel or mischmetal may be added.

U.S. Pat. No. 4,929,423 discloses a lead-free solder containing 0.08 to 20% bismuth, 0.02 to 1.5% copper, 0.01 to 1.5% silver, 0 to 0.1% phosphorous, and 0 to 20% mischmetal and the balance tin.

The cost of alloys containing large quantities of bismuth is another concern because bismuth is much more expensive than lead. Questions arise concerning the cost compatibility of bismuth containing alloys as substitutes for leaded alloys. If bismuth-containing lead-free alloys are too expensive, industry may adopt less satisfactory substitutes such as plastic. While there have been numerous attempts to provide low lead or lead-free copper base alloys, to date, none have proven to be commercially successful.

SUMMARY OF THE INVENTION

It has now been found that lead-free copper base alloys having properties comparable to leaded copper base alloys can be obtained from bismuth-containing copper base alloys which contain mischmetal or its rare earth equivalent. It has been found that the addition of mischmetal or its rare earth equivalent to bismuth containing copper alloys refines the grain and improves the distribution of bismuth in the copper matrix and provides an alloy which can be readily substituted for its leaded counterpart. Without mischmetal or its rare earth equivalent, the grain distribution is very nonuniform. With mischmetal, the bismuth distribution is very uniform and the lubricity of the alloy is uniform throughout the surface which makes the alloy readily machinable and easier to polish, buff and plate in faucet applications.

The alloys of the invention are cast alloys having the following composition:

| | |
|---|---|
| bismuth | about 0.1 to 7% |
| mischmetal or its rare earth equivalent | about 0.01 to 2% |
| tin | 0 to about 20% |
| zinc | 0 to about 42% |
| nickel | 0 to about 27% |
| manganese | 0 to about 15% |
| silicon | 0 to about 6% |
| aluminum | 0 to about 11% |
| iron | 0 to about 5% |
| lead | 0 to about 4% |
| antimony | 0 to about 1% |
| selenium | 0 to about 1% |
| tellurium | 0 to about 1% |
| zirconium | 0 to about 1% |
| boron | 0 to about 1% |
| silver | 0 to about 1% |
| cobalt | 0 to about 1% |
| chromium | 0 to about 1% |
| titanium | 0 to about 1% |
| phosphorous | 0 to about 1% |
| copper | at least 50% |

Typically, the copper comprises 65–95% of the alloy and, more particularly, comprises 75–90% of the alloy. The alloys in accordance with the invention may be modified to include selenium or tellurium to improve machinability, silver may be added to assist in alloying the bismuth, zirconium and boron may be used to refine grain size, and cobalt and chromium may be added to improve strength.

The term "bismuth equivalent" as used herein means the bismuth-containing alloy having a metallic composition which parallels a conventional leaded alloy except that all (in the preferred case) or at least a majority of the lead is replaced by bismuth and the alloy contains about 0.1% to 2% mischmetal or its rare earth equivalent. The amount of bismuth can be equal to the amount of lead in the conventional alloy on a weight basis or less bismuth can be used. Due to the brittleness encountered with bismuth, the amount of bismuth is preferably not greater than 7% and more preferably is 4% or less.

While it is a principal object of the invention to provide alloys which are lead free or substantially lead free, because lead-free scrap is more expensive than leaded scrap, those skilled in the art may elect to use quantities of leaded scrap in preparing their alloys to reduce expense. While this partially defeats the environmental and occupational advantages of removing lead, the addition of mischmetal in accordance with the invention is nevertheless effective in alloys containing small amounts of lead. Hence, while the invention is directed to alloys which are lead-free or which contain lead at the level of an incidental impurity, it will not circumvent the invention to incorporate small amounts of lead, e.g., up to 4% in the alloy.

The term "lead-free" as used herein means that lead, if present in the alloy, is present in an amount no more than an incidental impurity, e.g., in the case of lead 0.8% or less.

The term "low lead" as used herein means lead is present in the alloy in an amount greater than an incidental impurity up to 4%, e.g., greater than 0.8% to 4%.

In addition to containing bismuth, tin, copper, zinc, nickel and mischmetal in the amounts previously indicated, the invention is open to the inclusion of those elements occurring in conventional casting alloys. These include iron (typically in an amount of up to 0.3%), antimony (typically in an amount of up to 0.25%), sulphur (typically in an amount of up to 0.08%), phosphorous (typically in an amount of up to 0.05%), aluminum (typically in an amount of up to 0.005%), and silicon (typically in an amount of up to 0.005%). These additives are generally present in a total amount less than 1%.

The present invention more particularly provides a lead-free or low lead copper alloy which comprises about 0.1 to 7% bismuth, about 0.1 to 1% mischmetal, 0 to about 16% tin, 0 to about 25% zinc, 0 to about 27% nickel, 0 to about 23% manganese, 0 to about 1% antimony, 0 to about 1% selenium, 0 to about 1% tellurium, 0 to about 6% silicon, 0 to about 11% aluminum, 0 to about 5% iron, up to 4% lead, and the balance being copper and incidental impurities.

A more particular embodiment of the invention is a lead-free or a low lead copper alloy which comprises about 0.1 to 7.0% bismuth, 0 to about 16% tin, 0 to about 25% zinc, up to 27% nickel, about 0.1 to 1% mischmetal and the balance being essentially copper and incidental impurities.

In another embodiment of the invention, the alloys are lead free or low lead substitutes for leaded brasses and comprise about 2 to 4% bismuth, about 2 to 6% tin, about 4 to 10% zinc, about 0.5 to 1% nickel, about 0.1 to 0.5% mischmetal and the balance (typically about 82 to 94%) copper and incidental impurities. The alloys may also contain small amounts of elemental additives commonly present in copper-base casting alloys. Included in the invention are bismuth equivalents of C8330, C83400, C83410, C83420, C83450, C83500, C83520, C83600 (preferred), C83700, C83800 and C83810. The copper alloy numbers referenced herein are the reference numbers used by the Copper Development Association (CDA).

Another group of alloys in accordance with the invention are bismuth equivalents of semi-red brasses. These alloys typically contain about 2 to 6% tin, about 0.1 to 7% bismuth, about 7 to 17% zinc, about 0.4% iron, about 0.25% antimony, about 0.8 to 1% nickel, about 0.1 to 2% mischmetal or its rare earth equivalent and the balance (about 75 to 82%) copper and incidental impurities. These alloys include bismuth equivalents of alloys C84200, C84400, C84410, C84500, and C84800.

Various other lead-free or low lead alloys can be prepared by substituting bismuth for lead and using mischmetal to improve the grain size of the bismuth and in turn improve the machinability of the alloys.

In a further embodiment of the invention, low lead or lead free silicon brasses and silicon bronzes are provided. These alloys typically contain about 0.1 to 6% silicon and, more typically, about 0.8 to 5.5% silicon and still more typically about 2.5 to 5.5% silicon. The composition of silicon brasses is typically made up of at least 79% copper and 0.1% to 1% bismuth, 12.0 to 16.0% zinc, 0.5 to 0.8% aluminum and 2.5 to 5.0% silicon and 0.1 to 1% mischmetal or its rare earth equivalent and incidental impurities. Included within the invention are bismuth equivalents of copper-silicon alloys C87300, C87400, C87410, C87420, C87430, C87500 (preferred), C87510, C87520, C87530, C87600, C87610, C87800, and C87900.

Another alloy in accordance with the invention is a lead-free or a low lead aluminum bronze. These alloys contain about 0.1 to 11% aluminum and about 0.1 to 5% iron with the balance being copper and incidental impurities. More particularly, aluminum bronzes in accordance with the invention contain at least 78% copper and about 0.1 to 0.5% bismuth, about 0.25 to 5% nickel, about 0.5 to 5.5% iron, about 8.5 to 11% aluminum, about 0.5 to 3.5% manganese, 0 to about 0.25% silicon, 0 to about 0.5% zinc, 0 to about 0.10% tin and about 0.1 to 2% mischmetal or its rare earth equivalent. The invention includes bismuth equivalents of copper-aluminum-nickel alloys C95200, C95210, C95220, C95300, C95400 (preferred), C95410, C95420, and C95500.

A further manifestation of the invention is alloys which are substitutes for leaded nickel silver alloys. These alloys typically contain about 1.5 to 5.5% tin, up to about 25% zinc, about 0.1 to 7.0% bismuth, about 11 to 27% nickel, up to 1% manganese, about 0.1 to 1% mischmetal and the balance (typically about 53 to 67%) copper and incidental impurities. The invention includes bismuth equivalents of copper-nickel-zinc alloys C97300, C97400, C97600,and C97800.

The invention also includes bismuth equivalents of manganese bronzes. These alloys typically contain about 53 to 68% copper, about 0.2 to 1.5% tin, about 0.1 to 1.5% bismuth, about 22 to 38% zinc, about 0.4 to 4% iron, about 1 to 4% nickel, about 0.5 to 5.5% aluminum, about 1 to 5% manganese and about 0.1 to 2% mischmetal or its rare earth equivalent. Included in this class are bismuth equivalents of C86100, C86200, C86300, C86400 (preferred), C86500, C86700, and C86800. The invention further includes bismuth equivalents of alloys such as C99700 containing high amounts of manganese. One such alloy contains at least 54% copper, about 1 tin, about 0.1 to 2% bismuth, about 4 to 6% nickel, about 1% iron, about 0.5 to 3% aluminum, about 19 to 25% zinc, about 11 to 15% manganese and about 0.1 to 2% mischmetal or its rare earth equivalent.

The invention also includes tin bronzes containing about 6 to 20% tin, about 0.1 to 7% bismuth, about 0.25 to 5% zinc, about 0.1 to 0.5% iron, about 0.25 to 0.8% antimony, about 0.1 to 4.0% nickel (inclusive of cobalt), about 0.05% sulfur, about 0.05 to 1% phosphorus, about 0.1 to 2% mischmetal or its rare earth equivalent and the balance (typically about 68 to 90%) copper and incidental impurities. The invention includes bismuth equivalents of copper tin alloys such as C90200, C90300, C90500, C90700, C90900, C91100, C91300, C91600, C91700, C92200, C92300, C92410, C92500, C92800, C92900, C93200, C93400, C93500, C93700, C94300, and C94500.

Another manifestation of the invention is low lead or lead-free, low bismuth alloys. It has been found that with the addition of mischmetal or its rare earth equivalent, the bismuth content of many of the aforementioned alloys containing up to 7% bismuth can be held to less than 1.5%, more particularly, about 0.6 to 1.5% and still more particularly to about 0.6 to 0.9% and castable alloys having satisfactory machinability and pressure tightness can be obtained. More particularly, these alloys may contain 2 to 7% bismuth or they may be prepared as low bismuth alloys containing about 0.6 to 1.5% bismuth and more particularly 0.6 to 0.9% bismuth.

Still another manifestation of the invention is low tin alloys wherein any of the aforementioned alloys may be modified to contain less than 1% tin. These low tin alloys contain nickel; typically the nickel is present in an amount of about 1 to 8%.

DETAILED DESCRIPTION OF THE INVENTION

Figure 1:
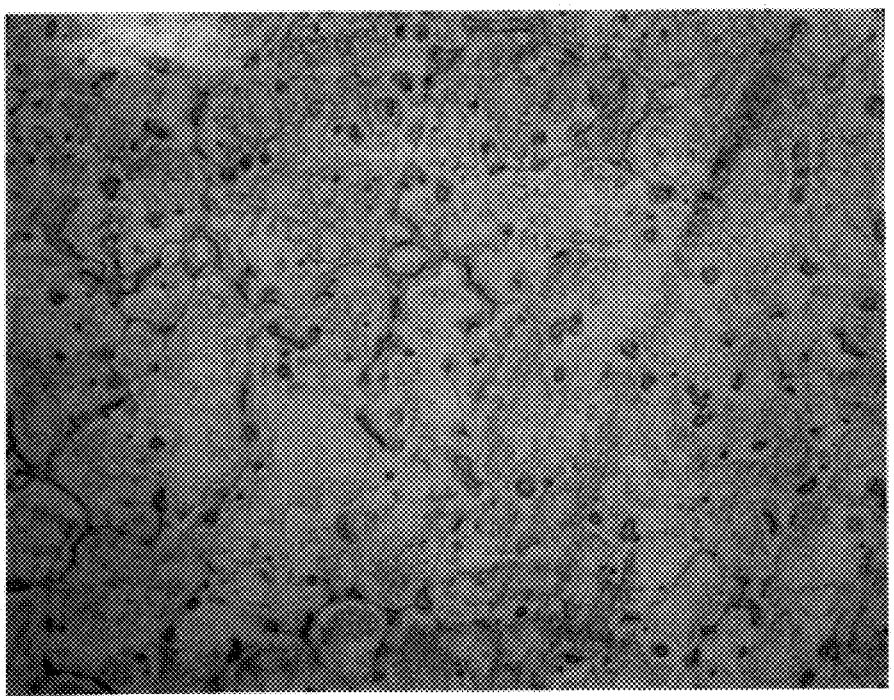
FIG. 1 is a photomicrograph showing the grain structure of an alloy of the present invention prepared in accordance with Example 1.

Mischmetal is a rare earth alloy. One such alloy contains 3% iron and 96% rare earth metals and 1% residuals. The rare earth content consists of 48–53% (typically 51.50%) cerium, 20–24% (typically 21.4%) lanthanum, 18–22% (typically 19.5%) neodymium, 4–7% (typically 5.4%) praseodymium and 1% other rare earth metal. Mischmetal, or its rare earth equivalent, may be used in the present invention. By rare earth equivalent it is meant alloys containing one or any combination of cerium, lanthanum and neodymium or an equivalent rare earth element. Michmetal or its equivalent is typically used in an amount of about 0.01 to 2%. However, those skilled in the art will recognize that lower amounts of this additive may have some efffect and that higher amounts are unnecessary in most applications.

Certain particular alloys in accordance with the invention are modifications of CDA alloys 83600, 84400 and 84800 which include up to 1% mischmetal and contain bismuth instead of lead. More particularly, an alloy substitute for C83600 in accordance with the present invention may contain about 84–86% copper, about 4–6% tin, about 4–6% zinc, about 4–6% bismuth, about 1% nickel, and about 0.1–1% mischmetal. An alloy substitute for C84400 may contain about 78–82% copper, about 2.3–3.5% tin, about 7–10% zinc, about 6–8% bismuth, about 1% nickel and about 0.1–1% mischmetal. An alloy substitute for C84800 may contain about 75–77% copper, about 2–3% tin, about 5.5–7% bismuth, about 13–17% zinc, about 1% nickel and about 0.1–1% mischmetal.

One low bismuth alloy in accordance with the invention may contain about 3 to 4% tin, about 6 to 8% zinc, about 0.6 to 0.9% bismuth, about 0.1 to 1% mischmetal and about 0.5 to 1% nickel and the balance copper and incidental impurities. A preferred low bismuth alloy contains 3.25 to 3.5% tin and 0.55 to 0.7% nickel.

In accordance with another particular embodiment of the invention, a low lead or lead-free nickel silver substitute is provided. One such alloy is a modification of CDA alloy 97300 and contains about 1.5 to 3.0% tin, about 0.1 to 7% bismuth, about 17 to 25% zinc, about 1.5% iron, about 11 to 14% nickel, about 0.5% manganese, about 0.1 to 1% mischmetal and the balance copper and incidental impurities.

In selected applications, it may be desirable to provide a low tin alloy. Tin can be reduced to levels less than 1% and replaced with up to about 8% nickel.

The invention is illustrated in more detail by the following non-limiting Examples:

Example 1

A lead-free brass alloy analogous to CDA C84400 having the following composition: 3.75% tin, 0.05% lead, 3.30% bismuth, 9.33% zinc, 0.1% mischmetal and the balance copper was prepared as follows:

A copper-based, lead-free scrap containing tin and zinc as principal alloying elements was melted in an induction furnace at about 2200° F. When the scrap was totally molten, it was degassed and deoxidized using standard foundry practices. 15% phosphor copper shot was added to deoxidize the metal. Metallic bismuth was added and stirred. After a few minutes of agitation, the mischmetal was introduced. The molten mixture was skimmed clean and poured into cast iron molds at about 2100° F. and the alloy was allowed to cool. Sections of 2 different 20–25 pound ingots were tested to determine the mechanical properties as cast with the following results:

| | Tensile Strength | Yield Strength (.5% Ext.) | % Elongation |
|---|---|---|---|
| Ingot 1 | 33,593 psi | 18,842 psi | 15.3 |
| Ingot 2 | 33,247 psi | 18,660 psi | 16.2 |

FIG. 1 shows a grain refinement of this alloy with uniform distribution of bismuth in the copper matrix at 200 magnification after etching with ammonium persulfate.

The Ingots were remelted in a gas-fired furnace without any cover of flux. At about 2100° F., the crucible containing the molten metal was skimmed clean and deoxidized with phosphor copper shots. At this point, the entire metal was poured into green sand molds to produce hundreds of castings with a wide variety of thicknesses of the type usually used in plumbing fittings.

Example 2

Using the procedure of Example 1, a lead-free brass alloy similar to CDA C83600 was prepared from a mixture of a lead-free scrap containing tin and zinc as the principal alloying elements and 90/10 copper-nickel scrap. This scrap mixture after becoming molten was degassed and deoxidized and finally refined with mischmetal. It was then skimmed clean and poured into cast iron ingot molds with the following composition: 3.51% tin, 0.14% lead, 2.92% bismuth, 5.16% zinc, 0.41% nickel, 0.2% mischmetal and the balance copper. To minimize cost, tin was deliberately figured approximately half a percent lower than sand cast alloy CDA C83600. A rectangular section of an ingot was sliced and tested mechanically as cast with the following results:

| | |
|---|---|
| Tensile Strength | 34,190 psi |
| Yield Strength (0.5% Ext.) | 17,168 psi |
| % Elongation | 21.6 |

Figure 2:
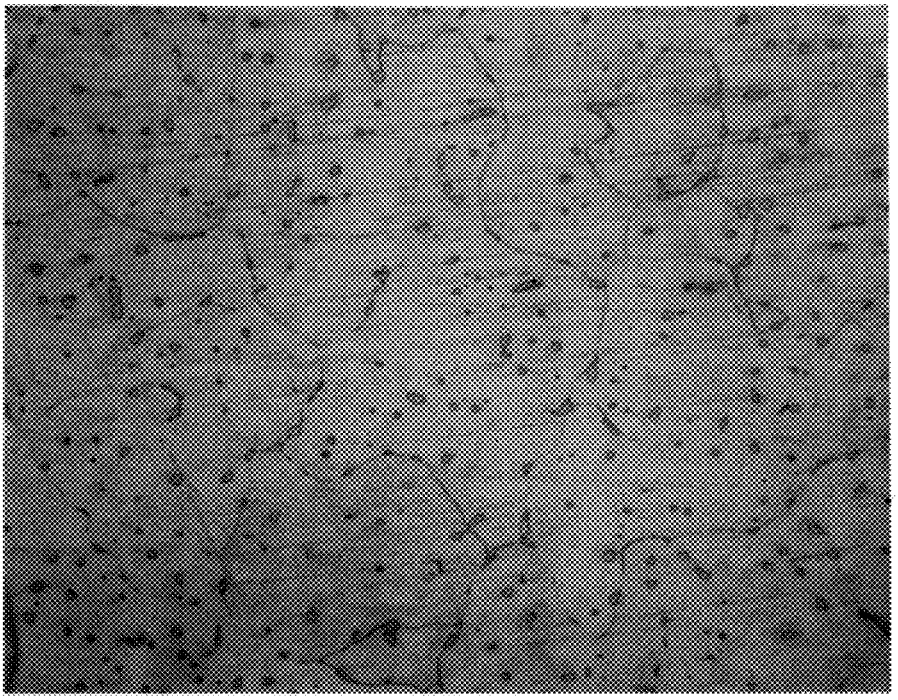
FIG. 2 is a photomicrograph of an alloy of the invention prepared in accordance with Example 2.

A small section of the ingot was polished, etched with ammonium persulfate, and photomicrographed at 200 magnification to provide FIG. 2.

Figure 3:
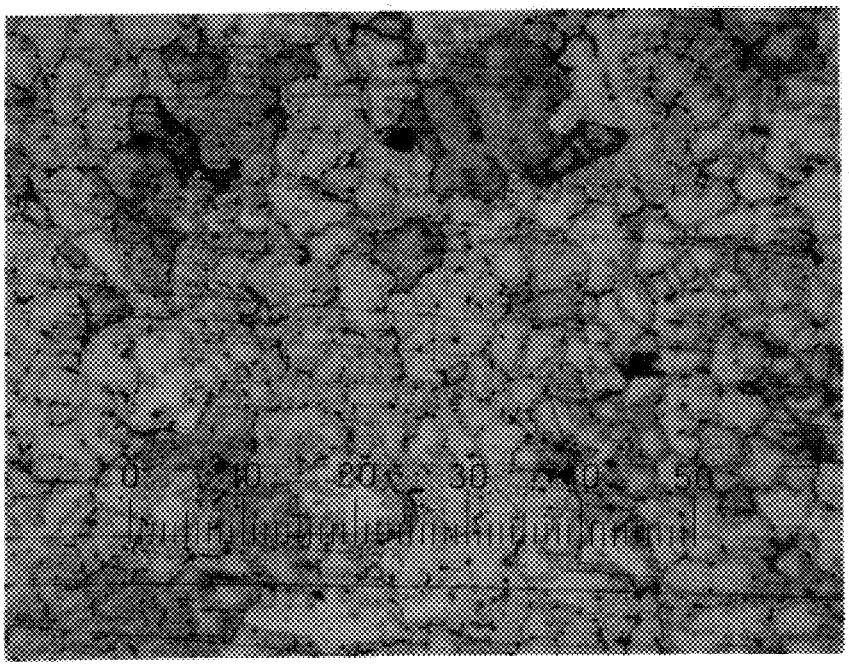
FIGS. 3 is a photomicrograph showing the grain structure of a casting prepared from the alloy of Example 2.

This alloy was sand cast in the same manner as Example 1 in order to produce a great variety of plumbing brass fittings. The test results were comparable to Example 1. In addition, a small section was prepared from a large casting etched with ammonium persulfate and the microstructure was studied at 75× magnification to provide (FIG. 3).

Example 3

Figure 4:
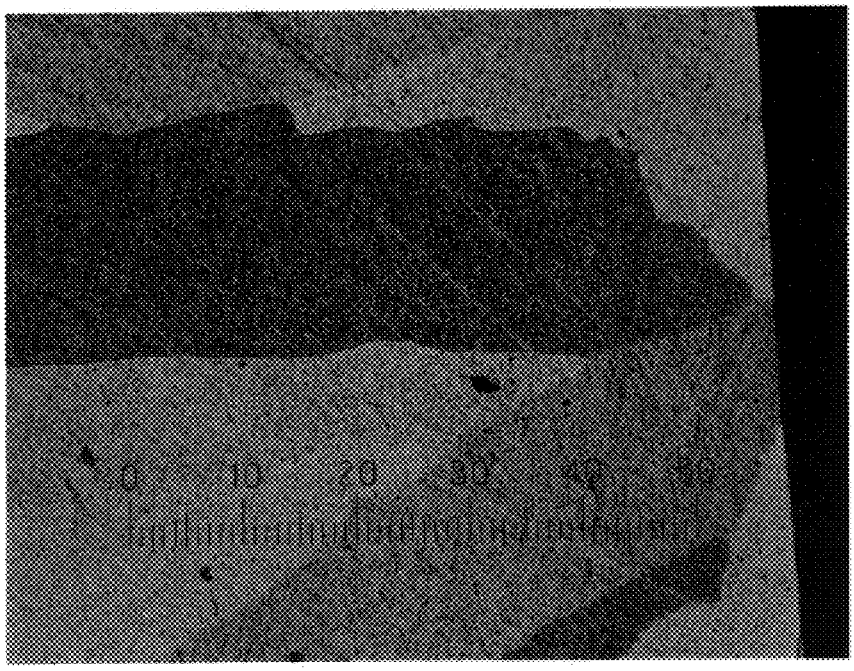
FIG. 4 is a photomicrograph showing the grain structure of an alloy nominally containing 90% copper and 10% zinc.
Figure 5:
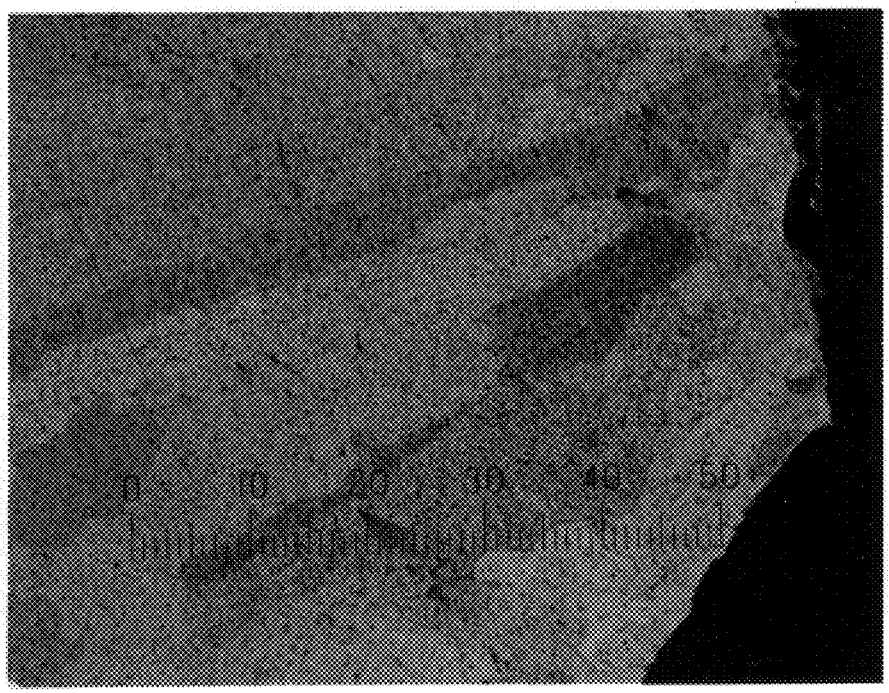
FIG. 5 is a photomicrograph showing the grain structure for the alloy of FIG. 4 modified to include 2% bismuth disclosed as in Example 3.
Figure 6:
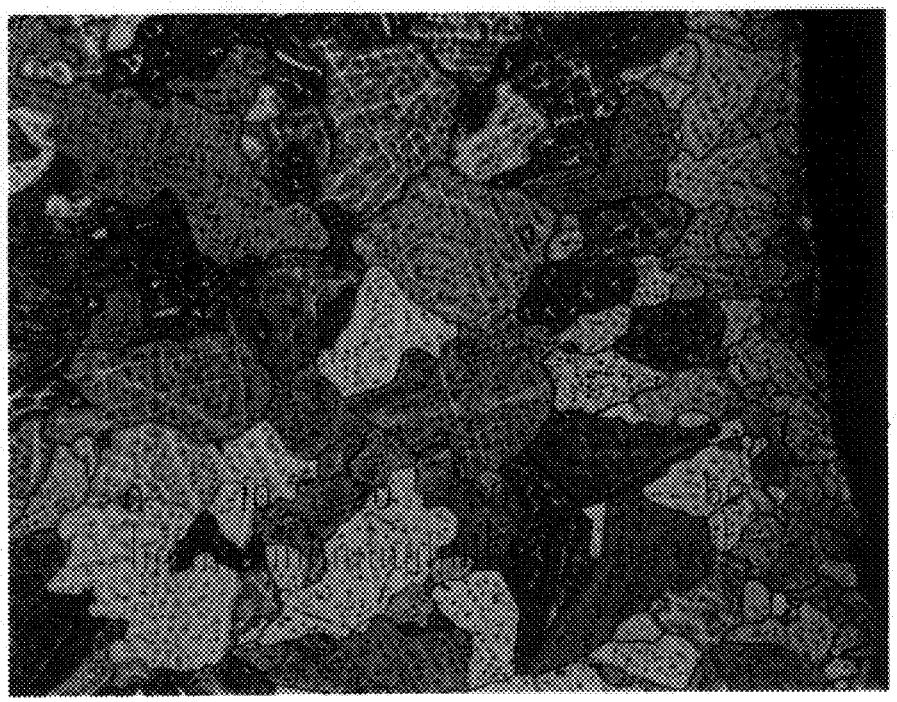
FIG. 6 is a photomicrograph showing the grain structure of the alloy of FIG. 5 further modified to include mischmetal as disclosed in Example 3.

This Example demonstrates the effect of the addition of mischmetal on the grain structure of bismuth alloys. Copper alloy CDA C83400, which is essentially an alloy of 90% copper and 10% zinc with trace amounts of tin and lead was remelted. When the metal was molten, a portion was poured into cast iron molds. This sample was eventually polished and etched with ammonium persulfate and a photomicrograph was made at 75× magnification to provide FIG. 4. Another portion of the alloy was modified by the addition of 2% bismuth and poured into cast iron molds, etched and photomicrographed at 75× to provide FIG. 5. A third portion of the alloy was modified with 2% bismuth and 1.0% mischmetal and poured, etched and photomicrographed in the same manner to provide FIG. 6. A comparison of FIGS. 4, 5 and 6 clearly reveals the dramatic change in the size of the grains after the introduction of mischmetal into the bismuth-containing alloy.

Example 4

Using the procedure of Example 1, a copper based lead free scrap containing tin and zinc as principal alloying elements was melted with copper-nickel scrap in a gas fired furnace. Eventually this mixture was alloyed with bismuth and mischmetal was introduced. The molten mixture was skimmed clean and poured into cast iron ingot molds at about 2100° F. with the following composition: 3.53% tin, 0.13% lead, 0.60% bismuth, 7.45% zinc, 0.41% nickel, 0.2% mischmetal and the balance copper.

The ingots prepared from the above alloy were remelted in a gas fired furnace without any cover of flux. At 2200° F., the molten metal was skimmed clean and deoxidized with 15% phosphor copper shot. A number of castings used in plumbing industry were made by pouring the metal into green sand molds. In addition, four test bars were poured into green sand molds in accordance with ASTM specification B 208. The results below show that the test bars provide tensile strength, yield strength, and elongation analogous to CDA 83600 Alloy and CDA 84400 Alloy.

| | Tensile Strength | Yield Strength (0.5% Ext.) | % Elongation |
|---|---|---|---|
| Test Bar 1 | 33,813 psi | 14,947 psi | 28.2 |
| Test Bar 2 | 33,325 psi | 14,887 psi | 28.8 |
| Test Bar 3 | 33,280 psi | 15,067 psi | 31.5 |
| Test Bar 4 | 31,692 psi | 14,947 psi | 24.2 |

While the invention has been illustrated using sand castings, the alloy can be cast as certrifugal, continuous, die, investment, permanent mold, plaster, and other types of casting.

Having described the invention in detail and by reference to preferred embodiments thereof, it will be apparent that modifications and variations are possible without departing from the scope of the invention defined in the appended claims.

What is claimed is:

1. A plumbing fixture or fitting cast from an alloy consisting essentially of about 0.1 to 7% bismuth, up to about 16% tin, about 4 to 25% zinc, up to about 27% nickel, about 0.1 to 1% mischmetal or its rare earth equivalent, and the balance copper and incidental impurities.

2. The alloy of claim 1 wherein copper is present in said alloy in an amount of about 75 to 77%, tin is present in said alloy in an amount of about 2 to 3%, bismuth is present in said alloy in an amount of about 5.5 to 7%, zinc is present in said alloy in an amount of about 13–17%, nickel is present in said alloy in an amount of about 0.5 to 1%, and mischmetal is present in said alloy in an amount of about 0.1 to 1%.

3. The alloy of claim 1 wherein tin is present in said alloy in an amount of about 1.5 to 5.5%, zinc is present in said alloy in an amount of about 4 to about 25%, bismuth is present in said alloy in an amount of about 0.1 to 7%, nickel is present in said alloy in an amount of about 11 to 27%, mischmetal is present in said alloy in an amount of about 0.1 to 1%, and manganese is present in said alloy in an amount up to about 1%.

4. The plumbing fixture or fitting of claim 1 wherein portions of said fixture which contact potable water are constructed from said alloy.

5. The plumbing fixture or fitting of claim 4 wherein the fixture or fitting is constructed from a lead-free alloy containing <1% bismuth.

6. The plumbing fixture or fitting of claim 1 wherein the fixture or fitting is a tap, a valve, a meter or a coupling.

7. The plumbing fixtures of claim 1 which the fixture in a faucet.

8. The plumbing fixture or fitting of claim 1 wherein said alloy is made up of bismuth, tin, copper, zinc and mischmetal.

9. The plumbing fixture or fitting of claim 1 wherein said alloy consists essentially of copper, bismuth, tin, zinc and mischmetal.

10. The plumbing fixture or fitting of claim 1 wherein said alloy contains a rare earth equivalent of mischmetal selected from the group consisting of cerium, lanthanum, and neodymium or a combination thereof, said rare earth equivalent being present in an amount of about 0.1 to 1%.

11. The plumbing fixture or fitting of claim 1 wherein said alloy contains mischmetal.

12. A plumbing fixture or fitting constructed from a cast alloy consisting essentially of:

| | |
|---|---|
| copper | at least 50% |
| bismuth | about 0.1 to 7% |
| mischmetal or its rare earth equivalent | about 0.01 to 2% |
| tin | up to about 20% |
| zinc | 4 to about 42% |
| nickel | 0 to about 27% |
| manganese | 0 to about 15% |
| silicon | 0 to about 6% |
| aluminum | 0 to about 11% |
| iron | 0 to about 5% |
| lead | 0 to about 4% |
| antimony | 0 to about 1% |
| selenium | 0 to about 1% |
| tellurium | 0 to about 1% |
| zirconium | 0 to about 1% |
| boron | 0 to about 1% |
| silver | 0 to about 1% |
| cobalt | 0 to about 1% |
| chromium | 0 to about 1% |
| phosphorus | 0 to about 1% |
| and incidental impurities. | |

13. The plumbing fixture or fitting of claim 12 wherein mischmetal is present in the alloy.

14. The plumbing fixture or fitting of claim 13 wherein the alloy contains no more than 0.8% lead.

15. The plumbing fixture or fitting of claim 14 wherein tin is present in the alloy.

* * * * *

UNITED STATES PATENT AND TRADEMARK OFFICE

CERTIFICATE OF CORRECTION

PATENT NO. : 5,942,056

DATED : August 24, 1999

INVENTOR(S) : Akhileshwar R. Singh

It is certified that error appears in the above-identified patent and that said Letters Patent is hereby corrected as shown below:

Col. 8, line 52 (claim 1) replace "0.1 to 7% bismuth" with --1 to 7% bismuth--.

Col. 9, line 13 (claim 7) after "claim 1" insert --in--.

Col. 10, line 3 (claim 12) after "bismuth" replace "about 0.1 to 7%" with --about 1 to 7%--.

Col. 10, line 4 (claim 12) after "mischmetal or its rare" replace "about 0.01 to 2%" with --about 0.1 to 2%--.

Signed and Sealed this

Twenty-fifth Day of January, 2000

*Attest:*

*Attesting Officer*

*Acting Commissioner of Patents and Trademarks*